US010192488B1

(12) United States Patent
Chen

(10) Patent No.: US 10,192,488 B1
(45) Date of Patent: Jan. 29, 2019

(54) OLED PIXEL DRIVING CIRCUIT AND OLED PIXEL DRIVING METHOD

(71) Applicant: Shenzhen China Star Optoelectronics Semiconductor Display Technology Co., Ltd., Shenzhen, Guangdong (CN)

(72) Inventor: Xiaolong Chen, Shenzhen (CN)

(73) Assignee: SHENZHEN CHINA STAR OPTOELECTRONICS SEMICONDUCTOR DISPLAY TECHNOLOGY CO., LTD. (CN)

( * ) Notice: Subject to any disclaimer, the term of this patent is extended or adjusted under 35 U.S.C. 154(b) by 0 days.

(21) Appl. No.: 15/574,027

(22) PCT Filed: Oct. 27, 2017

(86) PCT No.: PCT/CN2017/107966

§ 371 (c)(1),
(2) Date: Nov. 14, 2017

(30) Foreign Application Priority Data

Aug. 16, 2011 (CN) ..... 201710699755
Aug. 17, 2017 (CN) ..... 201710707276

(51) Int. Cl.
*G09G 3/3258* (2016.01)

(52) U.S. Cl.
CPC ... *G09G 3/3258* (2013.01); *G09G 2300/0819* (2013.01); *G09G 2320/0233* (2013.01); *G09G 2320/045* (2013.01)

(58) Field of Classification Search
CPC ..... G09G 2320/0233; G09G 2320/045; G09G 2300/0819
See application file for complete search history.

(56) References Cited

U.S. PATENT DOCUMENTS

| | | | | |
|---|---|---|---|---|
| 10,074,309 | B2 * | 9/2018 | Chen | G09G 3/3233 |
| 2009/0051628 | A1 * | 2/2009 | Kwon | G09G 3/3233 345/77 |
| 2011/0074757 | A1 * | 3/2011 | Chung | G09G 3/3233 345/211 |
| 2014/0354522 | A1 * | 12/2014 | Chung | G09G 3/003 345/82 |
| 2015/0371587 | A1 * | 12/2015 | Chen | G09G 3/3233 345/76 |
| 2016/0351123 | A1 * | 12/2016 | Qing | G09G 3/3275 |
| 2017/0069264 | A1 * | 3/2017 | Dai | G09G 3/3233 |
| 2017/0103701 | A1 * | 4/2017 | Zhu | G09G 3/3233 |
| 2018/0211601 | A1 * | 7/2018 | Chen | G09G 3/3225 |

* cited by examiner

*Primary Examiner* — Mihir K Rayan
(74) *Attorney, Agent, or Firm* — Emerson, Thomson & Bennett, LLC; Roger D. Emerson

(57) ABSTRACT

An OLED pixel driving circuit includes a first thin film transistor, a second thin film transistor, a third thin film transistor, a fourth thin film transistor, a fifth thin film transistor, a sixth thin film transistor, a capacitor and an OLED. A gate of the third thin film transistor receives a second scan signal, both a source of the third thin film transistor and a source of the fourth thin film transistor receive a data voltage or an initial voltage. A gate of the first thin film transistor is connected to a source of the second thin film transistor and one terminal of the capacitor, another terminal of the capacitor being grounded.

19 Claims, 4 Drawing Sheets

OLED PIXEL DRIVING CIRCUIT AND OLED PIXEL DRIVING METHOD

BACKGROUND

1. Field of the Invention

The present disclosure relates to a display technology, more particularly, to an organic light-emitting diode (OLED) pixel driving circuit and an OLED pixel driving method.

2. Description of the Related Art

OLED displays have many advantages, such as being self-luminous, having a low drive voltage, a high luminous efficiency, a short response time, high sharpness, a high contrast, a nearly 180-degree viewing angle, a wide using temperature range, being able to achieve flexible display and large-area full-color display, etc. As a result, OLED displays have become the most promising display device.

A traditional OLED pixel driving circuit is usually a 2T1C driving circuit, that is, a structure having two thin film transistors and a capacitor, which convert a voltage into a current.

As shown in FIG. 1, a 2T1C OLED pixel driving circuit in the related art includes a first thin film transistor T10, a second thin film transistor T20, a capacitor C10 and an OLED D10. The first thin film transistor T10 is a driving thin film transistor. The second thin film transistor T20 is a switching thin film transistor. The capacitor C10 is a storage capacitor. A gate of the second thin film transistor T20 receives a scan signal Gate, a source of the second thin film transistor T20 receives a data signal Data, a drain of the second thin film transistor T20 is electrically connected to a gate of the first thin film transistor T10. A source of the first thin film transistor T10 receives a positive power supply OVDD. A drain of the first thin film transistor T10 is electrically connected to an anode of the OLED D10. A cathode of the OLED D10 receives a negative power supply OVSS. One terminal of the capacitor C10 is electrically connected to the gate of the first thin film transistor T10. Another terminal of the capacitor C10 is electrically connected to the source of the first thin film transistor T10. When the 2T1C OLED pixel driving circuit drives the OLED D10, a current flowing through the OLED D10 satisfies:

$$I=k\times(V\text{gs}-V\text{th})^2;$$

Where I is the current flowing through the OLED D10, k is an intrinsic conduction factor of the driving thin film transistor, Vgs is a voltage difference between the gate and the source of the first thin film transistor T10, Vth is a threshold voltage of the first thin film transistor T10. It can be seen that the current flowing through the OLED D10 correlates with the threshold voltage of the driving thin film transistor.

Owing to factors, such as the instability of the panel process, the threshold voltage of the driving thin film transistors in all the pixel driving circuits of the panel varies. Even though an equivalent data voltage is applied to the driving thin film transistors in the pixel driving circuits, currents flowing into OLEDs are inconsistent, which in turn affects the uniformity of the displayed image quality. In addition, as the driving time of the driving thin film transistors become longer, the material of thin film transistors becomes aged and varied, thus causing a drift of the threshold voltage of the driving thin film transistors. Furthermore, since the material of the thin film transistors has different extent of aging, a drift amount of the threshold voltage of the driving thin film transistors also varies. The phenomenon of non-uniform panel display thus occurs. At the same time, the turn-on voltage of the driving thin film transistors is raised. The current flowing into the OLEDs is reduced. Consequently, problems of reduced panel brightness, reduced luminous efficiency, etc. are caused.

Therefore, there is a need to provide an OLED pixel driving circuit and an OLED pixel driving method to resolve the problems in the related art.

SUMMARY OF THE INVENTION

An objective of the present disclosure is to provide an OLED pixel driving circuit and an OLED pixel driving method that are able to increase the uniformity of panel display, panel brightness and luminous efficiency.

In order to resolve the above technical problems, the present disclosure provides an OLED pixel driving circuit. The OLED pixel driving circuit includes:

a first thin film transistor, a second thin film transistor, a third thin film transistor, a fourth thin film transistor, a fifth thin film transistor, a sixth thin film transistor, a capacitor and an OLED;

a gate of the fifth thin film transistor receiving a fourth scan signal, a source of the fifth thin film transistor receiving a positive power supply, a drain of the fifth thin film transistor being connected to a drain of the third thin film transistor and a source of the first thin film transistor;

a gate of the third thin film transistor receiving a second scan signal, both a source of the third thin film transistor and a source of the fourth thin film transistor receiving a data voltage or an initial voltage, a gate of the fourth thin film transistor receiving a third scan signal;

a gate of the first thin film transistor being connected to a source of the second thin film transistor and one terminal of the capacitor, another terminal of the capacitor being grounded;

a gate of the second thin film transistor receiving a first scan signal, a drain of the second thin film transistor being connected to a drain of first thin film transistor, a drain of the fourth thin film transistor and a drain of the sixth thin film transistor; and a gate of the sixth thin film transistor receiving the fourth scan signal, a source of the sixth thin film transistor being connected to an anode of the OLED, a cathode of the OLED receiving a negative power supply, wherein the first thin film transistor, the second thin film transistor, the third thin film transistor, the fourth thin film transistor, the fifth thin film transistor and the sixth thin film transistor are all P-type thin film transistors, wherein the first scan signal, the second scan signal, the third scan signal and the fourth scan signal are all generated through an external timing controller.

In the OLED pixel driving circuit, each of the first thin film transistor, the second thin film transistor, the third thin film transistor, the fourth thin film transistor, the fifth thin film transistor and the sixth thin film transistor is one of a low-temperature polysilicon thin film transistor, a metal oxide semiconductor thin film transistor and an amorphous silicon thin film transistor.

In the OLED pixel driving circuit, the first scan signal, the second scan signal, the third scan signal and the fourth scan signal correspond to an initialization stage, a threshold voltage storage stage and a light-emitting stage in sequence;

the first scan signal and the third scan signal are both at a low voltage level, and the second scan signal and the fourth scan signal are both at a high voltage level during the initialization stage;

the first scan signal and the second scan signal are both at the low voltage level, and the third scan signal and the fourth scan signal are both at the high voltage level during the threshold voltage storage stage;

the first scan signal, the second scan signal and the third scan signal are all at the high voltage level, and the fourth scan signal is at the low voltage level during the light-emitting stage.

In the OLED pixel driving circuit, both the source of the third thin film transistor and the source of the fourth thin film transistor receive the initial voltage during the initialization stage;

both the source of the third thin film transistor and the source of the fourth thin film transistor receive the data voltage during the threshold voltage storage stage and the light-emitting stage.

In the OLED pixel driving circuit, the first thin film transistor is a driving thin film transistor, the sixth thin film transistor is a switching thin film transistor.

In order to resolve the above technical problems, the present disclosure provides an OLED pixel driving circuit. The OLED pixel driving circuit includes:

a first thin film transistor, a second thin film transistor, a third thin film transistor, a fourth thin film transistor, a fifth thin film transistor, a sixth thin film transistor, a capacitor and an OLED;

a gate of the fifth thin film transistor receiving a fourth scan signal, a source of the fifth thin film transistor receiving a positive power supply, a drain of the fifth thin film transistor being connected to a drain of the third thin film transistor and a source of the first thin film transistor;

a gate of the third thin film transistor receiving a second scan signal, both a source of the third thin film transistor and a source of the fourth thin film transistor receiving a data voltage or an initial voltage, a gate of the fourth thin film transistor receiving a third scan signal;

a gate of the first thin film transistor being connected to a source of the second thin film transistor and one terminal of the capacitor, another terminal of the capacitor being grounded;

a gate of the second thin film transistor receiving a first scan signal, a drain of the second thin film transistor being connected to a drain of first thin film transistor, a drain of the fourth thin film transistor and a drain of the sixth thin film transistor; and a gate of the sixth thin film transistor receiving the fourth scan signal, a source of the sixth thin film transistor being connected to an anode of the OLED, a cathode of the OLED receiving a negative power supply.

In the OLED pixel driving circuit, each of the first thin film transistor, the second thin film transistor, the third thin film transistor, the fourth thin film transistor, the fifth thin film transistor and the sixth thin film transistor is one of a low-temperature polysilicon thin film transistor, a metal oxide semiconductor thin film transistor and an amorphous silicon thin film transistor.

In the OLED pixel driving circuit, the first thin film transistor, the second thin film transistor, the third thin film transistor, the fourth thin film transistor, the fifth thin film transistor and the sixth thin film transistor are all P-type thin film transistors.

In the OLED pixel driving circuit, the first scan signal, the second scan signal, the third scan signal and the fourth scan signal correspond to an initialization stage, a threshold voltage storage stage and a light-emitting stage in sequence;

the first scan signal and the third scan signal are both at a low voltage level, and the second scan signal and the fourth scan signal are both at a high voltage level during the initialization stage;

the first scan signal and the second scan signal are both at the low voltage level, and the third scan signal and the fourth scan signal are both at the high voltage level during the threshold voltage storage stage;

the first scan signal, the second scan signal and the third scan signal are all at the high voltage level, and the fourth scan signal is at the low voltage level during the light-emitting stage.

In the OLED pixel driving circuit, both the source of the third thin film transistor and the source of the fourth thin film transistor receive the initial voltage during the initialization stage;

both the source of the third thin film transistor and the source of the fourth thin film transistor receive the data voltage during the threshold voltage storage stage and the light-emitting stage.

In the OLED pixel driving circuit, the first scan signal, the second scan signal, the third scan signal and the fourth scan signal are all generated through an external timing controller.

In the OLED pixel driving circuit, the first thin film transistor is a driving thin film transistor, the sixth thin film transistor is a switching thin film transistor.

In order to resolve the above technical problems, the present disclosure provides an organic light-emitting diode (OLED) pixel driving method. The OLED pixel driving method includes: providing an OLED pixel driving circuit; entering an initialization stage; entering a threshold voltage storage stage; and entering a light-emitting stage. The OLED pixel driving circuit comprises: a first thin film transistor, a second thin film transistor, a third thin film transistor, a fourth thin film transistor, a fifth thin film transistor, a sixth thin film transistor, a capacitor and an OLED; a gate of the fifth thin film transistor receiving a fourth scan signal, a source of the fifth thin film transistor receiving a positive power supply, a drain of the fifth thin film transistor being connected to a drain of the third thin film transistor and a source of the first thin film transistor; a gate of the third thin film transistor receiving a second scan signal, both a source of the third thin film transistor and a source of the fourth thin film transistor receiving a data voltage or an initial voltage, a gate of the fourth thin film transistor receiving a third scan signal; a gate of the first thin film transistor being connected to a source of the second thin film transistor and one terminal of the capacitor, another terminal of the capacitor being grounded; a gate of the second thin film transistor receiving a first scan signal, a drain of the second thin film transistor being connected to a drain of first thin film transistor, a drain of the fourth thin film transistor and a drain of the sixth thin film transistor; and a gate of the sixth thin film transistor receiving the fourth scan signal, a source of the sixth thin film transistor being connected to an anode of the OLED, a cathode of the OLED receiving a negative power supply. During the initialization stage, the second thin film transistor is turned on due to a low voltage level of the first scan signal, the fourth thin film transistor is turned on due to a low voltage level of the third scan signal, the third thin film transistor is turned off due to a high voltage level of the second scan signal, the fifth and sixth thin film transistors are turned off due to a high voltage level of the fourth scan signal, and a voltage applied on the gate of the first thin film transistor is the initial voltage. During the threshold voltage storage stage, the second thin film transistor is turned on due to the low voltage level of the first scan signal, the third thin film transistor is turned on due to the low voltage level of the second scan signal, the fourth thin film transistor is turned off due to the high low voltage level of the third scan signal, the fifth and sixth thin film transistors are turned off due to the high voltage level of the fourth scan signal, and the voltage applied on the gate of the first thin film transistor varies to Vdata−Vth where Vdata is the data voltage, and Vth is the threshold voltage of the first thin film transistor. During the light-emitting stage, the second thin film transistor is turned off due to the high voltage level of the first scan signal, the third thin film transistor is turned off due to the high voltage level of the second scan signal, the fourth thin film transistor is turned off due to the high low voltage level of the third scan signal, the fifth and sixth thin film transistors are turned on due to the low voltage level of the fourth scan signal, the OLED emits light, so that a current flowing through the OLED does not correlate with a threshold voltage of the first thin film transistor.

In the OLED pixel driving method, a source voltage of the first thin film transistor is changed to the positive power supply and a gate voltage of the first thin film transistor remains unchanged during the light-emitting stage, so that a current flowing through the OLED does not correlate with the threshold voltage of the first thin film transistor.

In the OLED pixel driving method, both the source of the third thin film transistor and the source of the fourth thin film transistor receive the initial voltage during the initialization stage;

both the source of the third thin film transistor and the source of the fourth thin film transistor receive the data voltage during the threshold voltage storage stage and the light-emitting stage.

In the OLED pixel driving method, the first scan signal, the second scan signal, the third scan signal and the fourth scan signal are all generated through an external timing controller.

In the OLED pixel driving method, the first thin film transistor is a driving thin film transistor, the sixth thin film transistor is a switching thin film transistor.

In the OLED pixel driving method, each of the first thin film transistor, the second thin film transistor, the third thin film transistor, the fourth thin film transistor, the fifth thin film transistor and the sixth thin film transistor is one of a low-temperature polysilicon thin film transistor, a metal oxide semiconductor thin film transistor and an amorphous silicon thin film transistor.

In the OLED pixel driving method, the first thin film transistor, the second thin film transistor, the third thin film transistor, the fourth thin film transistor, the fifth thin film transistor and the sixth thin film transistor are all P-type thin film transistors.

The OLED pixel driving circuit and the OLED pixel driving method according to the present disclosure improve the pixel driving circuit in the related art to eliminate the influence of the threshold voltage of the driving thin film transistor on the OLED. The uniformity of panel display is increased. In addition, the problems, such as reduced panel brightness, reduced luminous efficiency, etc., owing to aging of the OLEDs are avoided.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

For the purpose of description rather than limitation, the following provides such specific details as a specific system structure, interface, and technology for a thorough understanding of the application. However, it is understandable by persons skilled in the art that the application can also be implemented in other embodiments not providing such specific details. In other cases, details of a well-known apparatus, circuit and method are omitted to avoid hindering the description of the application by unnecessary details.

In view of the problem of drift of the threshold voltage of the driving thin film transistors, the OLED pixel driving circuit is usually improved in the related art to increase numbers of thin film transistors and control signals corresponding to the thin film transistors so as to compensate for the threshold voltage of the driving thin film transistors. Thus, the current flowing through the OLEDs does not correlate with the threshold voltage of the driving thin film transistors when the OLEDs emit light.

Figure 1:
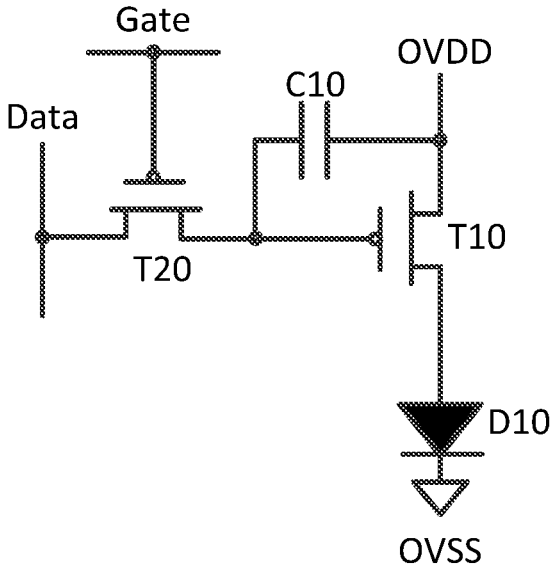
Fig. 1 (Related art)
FIG. 1 is a circuit diagram of a 2T1C pixel driving circuit for an OLED in the related art.
Figure 2:
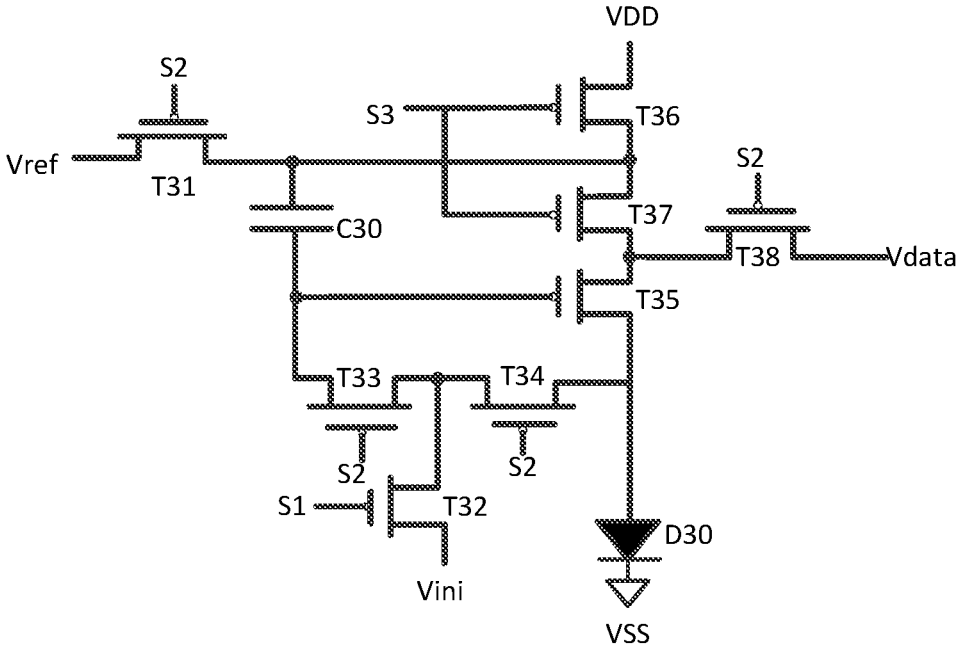
Fig. 2 (Related art)
FIG. 2 is a circuit diagram of a 8T1C pixel driving circuit for an OLED in the related art.

As shown on FIG. 2, an OLED pixel driving circuit in the related art adopts an 8T1C structure, that is, a structure having eight thin film transistors and a capacitor. The 8T1C OLED pixel driving circuit includes a first thin film transistor T31, a second thin film transistor T32, a third thin film transistor T33, a fourth thin film transistor T34, a fifth thin film transistor T35, a sixth thin film transistor T36, a seventh thin film transistor T37, an eighth thin film transistor T38, a capacitor C30 and an OLED D30. A gate of the first thin film transistor T31 receives a scan signal S2. A source of the first thin film transistor T31 receives a reference voltage Vref. A drain of the first thin film transistor T31 is connected to one terminal of the capacitor C30 and a source of the seventh thin film transistor T37. Another terminal of the capacitor C30 is connected to a source of the third thin film transistor T33 and a gate of the fifth thin film transistor T35. A drain of the third thin film transistor T33 is connected to a source of the fourth thin film transistor T34 and a drain of the second thin film transistor T32. Both a gate of the third thin film transistor T33 and a gate of the fourth thin film transistor T34 receive the scan signal S2. A gate of the second thin film transistor T32 receives a scan signal S1. A source of the second thin film transistor T32 receives an initial voltage Vin1.

A drain of the fourth thin film transistor T34 is connected to a drain of the fifth thin film transistor T35 and an anode of the OLED D30. A cathode of the OLED D30 receives a negative power supply VSS. A source of the fifth thin film transistor T35 is connected to a drain of the eighth thin film transistor T38 and a drain of the seventh thin film transistor T37. A source of the seventh thin film transistor T37 is connected to a drain of the sixth thin film transistor T36. A source of the sixth thin film transistor T36 receives a positive power supply VDD. Both a gate of the sixth thin film transistor T36 and a gate of the seventh thin film transistor T37 receive a scan signal S3. A gate of the eighth thin film transistor T38 receives the scan signal S2. A source of the eighth thin film transistor T38 receives a data voltage Vdata.

Although the above 8T1C structure can eliminate Vth of driving TFTs, a greater number of TFTs are utilized. An aperture ratio of the panel is reduced so that display brightness is reduced. Additionally, more TFTs will cause problems, such as parasitic capacitors and the like. In addition to that, this structure requires two extra power supplies Vref and Vini, thus leading to a more complex hardware structure.

Figure 3:
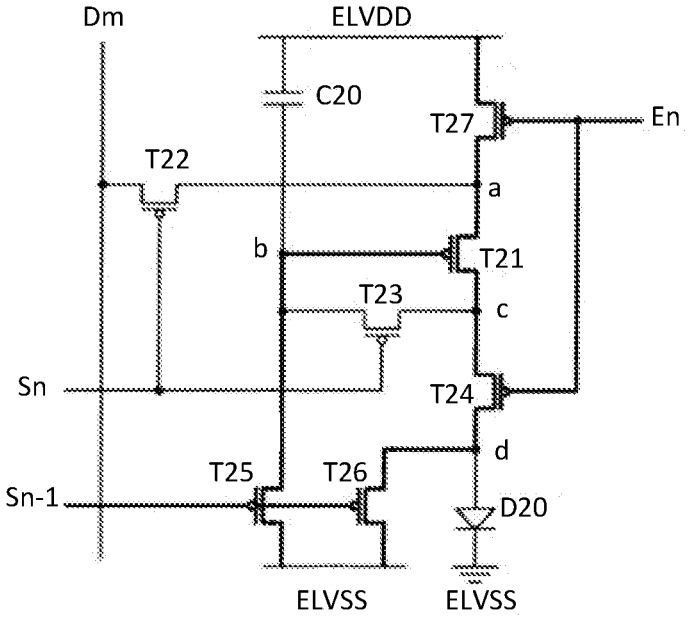
Fig. 3 (Related art)
FIG. 3 is a circuit diagram of a 7T1C pixel driving circuit for an OLED in the related art.

As shown in FIG. 3, another OLED pixel driving circuit in the related art adopts a 7T1C structure, that is, a structure having seven thin film transistors and a capacitor. The 7T1C OLED pixel driving circuit includes a first thin film transistor T21, a second thin film transistor T22, a third thin film transistor T23, a fourth thin film transistor T24, a fifth thin film transistor T25, a sixth thin film transistor T26, a seventh thin film transistor T27, a capacitor C20 and an OLED D20. In greater detail, the connection method between elements is as follows. One terminal of the capacitor C20 receives a positive power supply ELVDD. Another terminal of the capacitor C20 is connected to a second node b. A gate of the seventh thin film transistor T27 receives a light-emitting signal En. A source of the seventh thin film transistor T27 receives the positive power supply ELVDD. A drain of the seventh thin film transistor T27 is connected to a node a. A gate of the first thin film transistor T21 is connected to the second node b. A source of the first thin film transistor T21 is connected to the first node a. A drain of the first thin film transistor T21 is connected to a third node c. A gate of the third thin film transistor T23 receives a first scan signal Sn. A source of the third thin film transistor T23 is connected to the second node b. A drain of the third thin film transistor T23 is connected to the third node c. A gate of the fourth thin film transistor T24 receives the light-emitting signal En. A source of the fourth thin film transistor T24 is connected to the third node c. A drain of the fourth thin film transistor T24 is connected to a fourth node d. An anode of the OLED D20 is connected to the fourth node d. A cathode of the OLED D20 receives a negative power supply ELVSS. A gate of the fifth thin film transistor T25 receives a second scan signal Sn−1. A drain of the fifth thin film transistor T25 is connected to the second node b. A source of the fifth thin film transistor T25 is connected to the negative power supply ELVSS. A gate. A gate of the sixth thin film transistor T26 receives the second scan signal Sn−1. A drain of the sixth thin film transistor T26 is connected to the fourth node d. A source of the sixth thin film transistor T26 is connected to the negative power supply ELVSS. A gate of the second thin film transistor T22 receives the first scan signal Sn. A source of the second thin film transistor T22 receives an input data signal Dm. A drain of the second thin film transistor T22 is connected to the first node a.

Although the above 7T1C compensation structure can eliminate Vth of driving TFTs, a greater number of TFTs are utilized. An aperture ratio of the panel is thus reduced to reduce display brightness. Additionally, more TFTs will cause some other problems, such as parasitic capacitors and the like.

Figure 4:
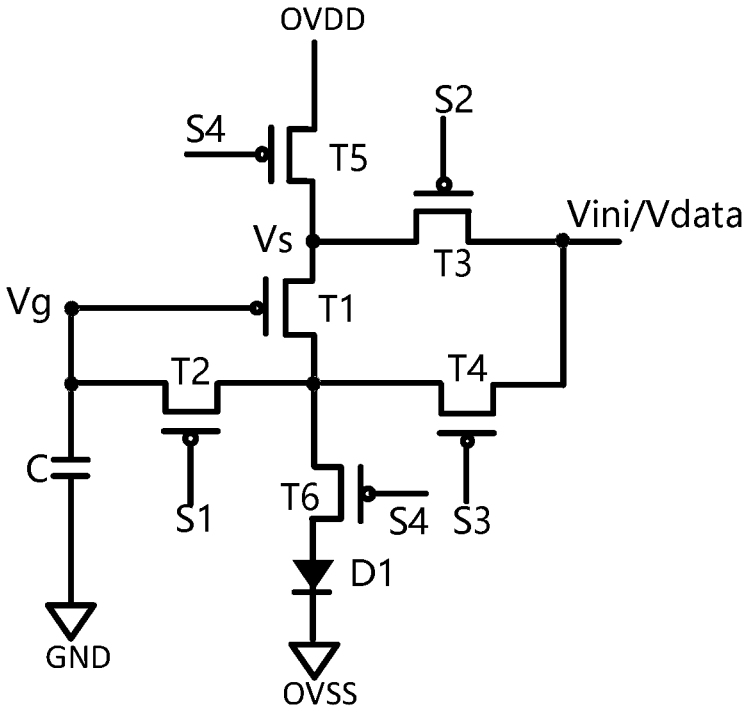
FIG. 4 is a circuit diagram of an OLED pixel driving circuit according to the present disclosure.

FIG. 4 is a circuit diagram of an OLED pixel driving circuit according to the present disclosure.

As shown in FIG. 4, the OLED pixel driving circuit according to the present disclosure includes a first thin film transistor T1, a second thin film transistor T2, a third thin film transistor T3, a fourth thin film transistor T4, a fifth thin film transistor T5, a sixth thin film transistor T6, a capacitor C and an OLED D1. The first thin film transistor T1 is a driving thin film transistor. The sixth thin film transistor T6 is a switching thin film transistor.

A gate of the fifth thin film transistor T5 receives a fourth scan signal S5. A source of the fifth thin film transistor T5 receives a positive power supply OVDD. A drain of the fifth thin film transistor T5 is connected to a drain of the third thin film transistor T3 and a source of the first thin film transistor T1.

A gate of the third thin film transistor T3 receives a second scan signal S2. Both a source of the third thin film transistor T3 and a source of the fourth thin film transistor T4 receive a data voltage Vdata or an initial voltage Vini. A gate of the fourth thin film transistor T4 receives a third scan signal S3. During an initialization stage, both the source of the third thin film transistor T3 and the source of the fourth thin film transistor T4 receive the initial voltage Vini.

During a threshold voltage storage stage and a light-emitting stage, both the source of the third thin film transistor T3 and the source of the fourth thin film transistor T4 receive the data voltage Vdata.

A gate of the first thin film transistor T1 is connected to a source of the second thin film transistor T2 and one terminal of the capacitor C. Another terminal of the capacitor C is grounded.

A gate of the second thin film transistor T2 receives a first scan signal S1. A drain of the second thin film transistor T2 is connected to a drain of first thin film transistor T1, a drain of the fourth thin film transistor T4 and a drain of the sixth thin film transistor T6.

A gate of the sixth thin film transistor T6 receives the fourth scan signal S4. A source of the sixth thin film transistor T6 is connected to an anode of the OLED D1. A cathode of the OLED D1 receives a negative power supply OVSS.

Each of the first thin film transistor T1, the second thin film transistor T2, the third thin film transistor T3, the fourth thin film transistor T4, the fifth thin film transistor T5 and the sixth thin film transistor T6 is one of a low-temperature polysilicon thin film transistor, a metal oxide semiconductor thin film transistor and an amorphous silicon thin film transistor.

The first scan signal S1, the second scan signal S2, the third scan signal S3 and the fourth scan signal S4 are all generated through an external timing controller.

The first thin film transistor T1, the second thin film transistor T2, the third thin film transistor T3, the fourth thin film transistor T4, the fifth thin film transistor T5 and the sixth thin film transistor T6 are all P-type thin film transistors.

The first scan signal S1, the second scan signal S2, the third scan signal S3 and the fourth scan signal S4 correspond to the initialization stage, the threshold voltage storage stage and the light-emitting stage in sequence.

Based on the above OLED pixel driving circuit, the present disclosure further provides an OLED pixel driving method. The OLED pixel driving method can begin at block S101.

S101, an OLED pixel driving circuit is provided.

Details may be referred to FIG. 4 and the above description, and a description in this regard is not provided.

S102, an initialization stage is entered.

Figure 5:
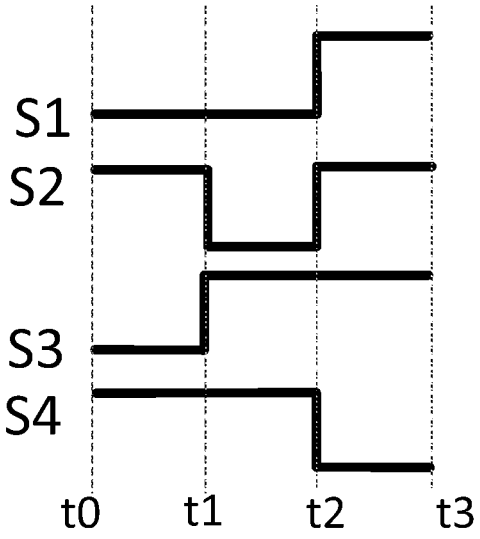
FIG. 5 is a timing diagram of an OLED pixel driving circuit according to the present disclosure.
Figure 6:
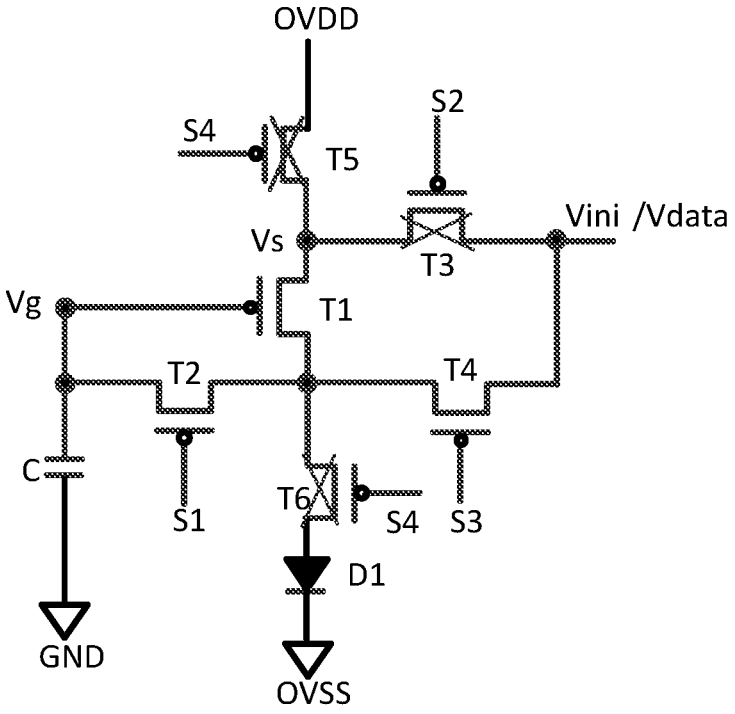
FIG. 6 is a schematic diagram of block 2 of an OLED pixel driving method according to the present disclosure.

A description is provided with reference to FIG. 5 and FIG. 6. During the initialization stage, that is, a time slot between t0 and t1, the first scan signal S1 and the third scan signal S3 are both at a low voltage level, the second scan signal S2 and the fourth scan signal S4 are both at a high voltage level.

The first scan signal S1 provides the low voltage level. The second thin film transistor T2 is turned on. The third scan signal S3 provides the low voltage level. The fourth thin film transistor T3 is turned on. The second scan signal S2 provides the high voltage level. The third thin film transistor T3 is turned off. The fourth scan line S4 provides the high voltage level. The fifth and the sixth thin film transistors T5, T6 are turned off.

Since the second and the fourth thin film transistors T2, T4 are turned on, Vini passes through the second and the fourth thin film transistors T2, T4 to charge the gate (point g) of the first thin film transistor T1. As a result, a gate voltage Vg of the first thin film transistor T1 is equal to the initial voltage Vini. The initial voltage Vini output from a data line satisfies the following equation:

$$Vini<Vdata-Vth;$$

Since the sixth thin film transistor T6 is turned off, the OLED D1 does not emit light. Initialization of an electric potential at the point g is completed in this stage.

S103, a threshold voltage storage stage is entered.

Figure 7:
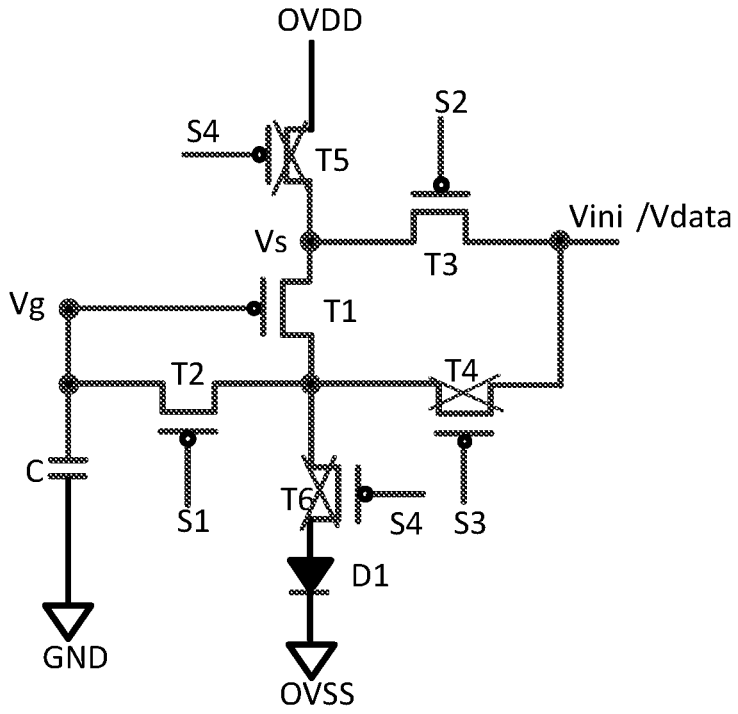
FIG. 7 is a schematic diagram of block 3 of an OLED pixel driving method according to the present disclosure.

A description is provided with reference to FIG. 5 and FIG. 7. During the threshold voltage storage stage, that is, a time slot between t1 and t2, the first scan signal S1 and the second scan signal S2 are both at the low voltage level, the third scan signal S3 and the fourth scan signal S4 are both at the high voltage level.

The first scan signal S1 provides the low voltage level. The second thin film transistor T2 is turned on. The second scan signal S2 provides the low voltage level. The third thin film transistor T3 is turned on. The third scan signal S3 provides the high voltage level. The fourth thin film transistor T4 is turned off. The fourth scan line S4 provides the high voltage level. The fifth and the sixth thin film transistors T5, T6 are turned off.

Since the third thin film transistor T3 is turned on, Vdata passes through the third thin film transistor T3 to charge the source (point s) of the first thin film transistor T1. As a result, a source voltage Vs of the first thin film transistor T1 is equal to the data voltage Vdata. Since the second thin film transistor T2 is turned on and the fourth and the sixth thin film transistors T4, T6 are turned off, the electric potential at the point g is charged through the second, the first and the third thin film transistors T2, T1, T3 until a voltage difference between the point s and the point g reaches a threshold voltage Vth of the driving thin film transistor (T1). The driving thin film transistor (T1) is thus cut off.

Since Vs and Vg satisfy the following equation:

$$Vs-Vg=Vth;$$

Where Vs=Vdata;

Vg is calculated as follows by combining the above equations:

$$Vg=Vdata-Vth$$

That is, the gate voltage of the first thin film transistor T1 is changed to Vdata−Vth, where Vdata is the data voltage, and Vth is the threshold voltage of the first thin film transistor T1.

Since the sixth thin film transistor T6 is turned off, the OLED D1 does not emit light. Storage of the electric potential at the point g is completed in this stage.

S104, a light-emitting stage is entered.

Figure 8:
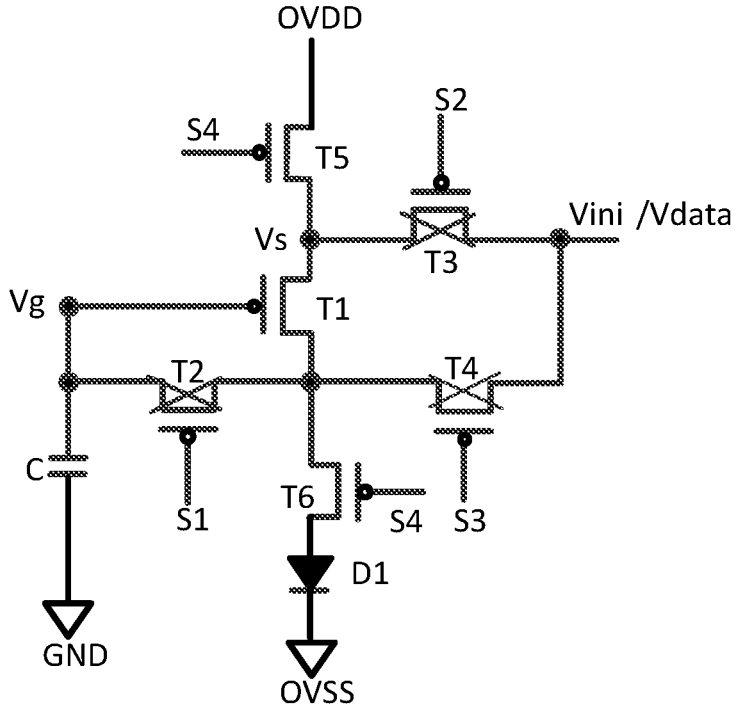
FIG. 8 is a schematic diagram of block 4 of an OLED pixel driving method according to the present disclosure.

A description is provided with reference to FIG. 5 and FIG. 8. During the light-emitting stage, that is, a time slot between t2 and t3, the first scan signal S1, the second scan signal S2 and the third scan signal S3 are all at the high voltage level, the fourth scan signal S4 is at the low voltage level.

The first scan signal S1 provides the high voltage level. The second thin film transistor T2 is turned off. The second scan signal S2 provides the high voltage level. The third thin film transistor T3 is turned off. The third scan signal S3 provides the high voltage level. The fourth thin film transistor T4 is turned off. The fourth scan line S4 provides the low voltage level. The fifth and the sixth thin film transistors T5, T6 are turned on. Since the fifth and the sixth thin film transistors T5, T6 are turned on, the OLED D1 emits light, and a current flowing through the OLED D1 does not correlate with the threshold voltage of the first thin film transistor T1.

In greater detail, since the second thin film transistor T2 is turned off, the electric potential at the point g, that is, the gate voltage Vg of the first thin film transistor T1 remains unchanged. In other words, the electric potential at the point g is the same as the gate voltage during the threshold voltage storage stage. Vg is as follows:

$$Vg=Vdata-Vth$$

Since the third thin film transistor T3 is turned off and the fifth thin film transistor T5 is turned on, OVDD charges the source of the first thin film transistor T1 through the fifth thin film transistor T5. As a result, an electric potential at the point s is changed as follows:

$$Vs=OVDD;$$

The voltage difference Vsg between the point s and the point g is thus changed as follows:

$$Vsg=Vs-Vg=OVDD-(Vdata-Vth)=OVDD-Vdata+Vth;$$

Since the current flowing through the OLED D1 satisfies the following equation:

$$I=k(Vsg-Vth)^2$$

A current finally flowing through the OLED D1 is calculated as follows by combining the above equations:

$$I=k(OVDD-Vdata)^2$$

It is thus understood that the current flowing through the OLED D1 does not correlate with the threshold voltage Vth of the driving thin film transistor (T1), which eliminates the influence of the threshold voltage Vth on the OLED. As a result, the uniformity of panel display and luminous efficiency are increased.

The OLED pixel driving circuit and the OLED pixel driving method according to the present disclosure improve the pixel driving circuit in the related art to eliminate the influence of the threshold voltage of the driving thin film transistor on the OLED. The uniformity of panel display is increased. In addition, the problems, such as reduced panel brightness, reduced luminous efficiency, etc., owing to aging of the OLEDs are avoided.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

What is claimed is:

1. An organic light-emitting diode (OLED) pixel driving circuit comprising:

a first thin film transistor, a second thin film transistor, a third thin film transistor, a fourth thin film transistor, a fifth thin film transistor, a sixth thin film transistor, a capacitor and an OLED;

a gate of the fifth thin film transistor receiving a fourth scan signal, a source of the fifth thin film transistor receiving a positive power supply, a drain of the fifth thin film transistor being connected to a drain of the third thin film transistor and a source of the first thin film transistor;

a gate of the third thin film transistor receiving a second scan signal, both a source of the third thin film transistor and a source of the fourth thin film transistor receiving a data voltage or an initial voltage, a gate of the fourth thin film transistor receiving a third scan signal;

a gate of the first thin film transistor being connected to a source of the second thin film transistor and one terminal of the capacitor, another terminal of the capacitor being grounded;

a gate of the second thin film transistor receiving a first scan signal, a drain of the second thin film transistor being connected to a drain of first thin film transistor, a drain of the fourth thin film transistor and a drain of the sixth thin film transistor; and a gate of the sixth thin film transistor receiving the fourth scan signal, a source of the sixth thin film transistor being connected to an anode of the OLED, a cathode of the OLED receiving a negative power supply, wherein the first thin film transistor, the second thin film transistor, the third thin film transistor, the fourth thin film transistor, the fifth thin film transistor and the sixth thin film transistor are all P-type thin film transistors, wherein the first scan signal, the second scan signal, the third scan signal and the fourth scan signal are all generated through an external timing controller.

2. The OLED pixel driving circuit as claimed in claim 1, wherein each of the first thin film transistor, the second thin film transistor, the third thin film transistor, the fourth thin film transistor, the fifth thin film transistor and the sixth thin film transistor is one of a low-temperature polysilicon thin film transistor, a metal oxide semiconductor thin film transistor and an amorphous silicon thin film transistor.

3. The OLED pixel driving circuit as claimed in claim 1, wherein the first scan signal, the second scan signal, the third scan signal and the fourth scan signal correspond to an initialization stage, a threshold voltage storage stage and a light-emitting stage in sequence;

the first scan signal and the third scan signal are both at a low voltage level, and the second scan signal and the fourth scan signal are both at a high voltage level during the initialization stage;

the first scan signal and the second scan signal are both at the low voltage level, and the third scan signal and the fourth scan signal are both at the high voltage level during the threshold voltage storage stage;

the first scan signal, the second scan signal and the third scan signal are all at the high voltage level, and the fourth scan signal is at the low voltage level during the light-emitting stage.

4. The OLED pixel driving circuit as claimed in claim 3, wherein both the source of the third thin film transistor and the source of the fourth thin film transistor receive the initial voltage during the initialization stage;

both the source of the third thin film transistor and the source of the fourth thin film transistor receive the data voltage during the threshold voltage storage stage and the light-emitting stage.

5. The OLED pixel driving circuit as claimed in claim 1, wherein the first thin film transistor is a driving thin film transistor, the sixth thin film transistor is a switching thin film transistor.

6. An organic light-emitting diode (OLED) pixel driving circuit comprising:

a first thin film transistor, a second thin film transistor, a third thin film transistor, a fourth thin film transistor, a fifth thin film transistor, a sixth thin film transistor, a capacitor and an OLED;

a gate of the fifth thin film transistor receiving a fourth scan signal, a source of the fifth thin film transistor receiving a positive power supply, a drain of the fifth thin film transistor being connected to a drain of the third thin film transistor and a source of the first thin film transistor;

a gate of the third thin film transistor receiving a second scan signal, both a source of the third thin film transistor and a source of the fourth thin film transistor receiving a data voltage or an initial voltage, a gate of the fourth thin film transistor receiving a third scan signal;

a gate of the first thin film transistor being connected to a source of the second thin film transistor and one terminal of the capacitor, another terminal of the capacitor being grounded;

a gate of the second thin film transistor receiving a first scan signal, a drain of the second thin film transistor being connected to a drain of first thin film transistor, a drain of the fourth thin film transistor and a drain of the sixth thin film transistor; and a gate of the sixth thin film transistor receiving the fourth scan signal, a source of the sixth thin film transistor being connected to an anode of the OLED, a cathode of the OLED receiving a negative power supply.

7. The OLED pixel driving circuit as claimed in claim 6, wherein each of the first thin film transistor, the second thin film transistor, the third thin film transistor, the fourth thin film transistor, the fifth thin film transistor and the sixth thin film transistor is one of a low-temperature polysilicon thin film transistor, a metal oxide semiconductor thin film transistor and an amorphous silicon thin film transistor.

8. The OLED pixel driving circuit as claimed in claim 6, wherein the first thin film transistor, the second thin film transistor, the third thin film transistor, the fourth thin film transistor, the fifth thin film transistor and the sixth thin film transistor are all P-type thin film transistors.

9. The OLED pixel driving circuit as claimed in claim 8, wherein the first scan signal, the second scan signal, the third scan signal and the fourth scan signal correspond to an initialization stage, a threshold voltage storage stage and a light-emitting stage in sequence;

the first scan signal and the third scan signal are both at a low voltage level, and the second scan signal and the fourth scan signal are both at a high voltage level during the initialization stage;

the first scan signal and the second scan signal are both at the low voltage level, and the third scan signal and the fourth scan signal are both at the high voltage level during the threshold voltage storage stage;

the first scan signal, the second scan signal and the third scan signal are all at the high voltage level, and the fourth scan signal is at the low voltage level during the light-emitting stage.

10. The OLED pixel driving circuit as claimed in claim 9, wherein both the source of the third thin film transistor and the source of the fourth thin film transistor receive the initial voltage during the initialization stage;

both the source of the third thin film transistor and the source of the fourth thin film transistor receive the data voltage during the threshold voltage storage stage and the light-emitting stage.

11. The OLED pixel driving circuit as claimed in claim 6, wherein the first scan signal, the second scan signal, the third scan signal and the fourth scan signal are all generated through an external timing controller.

12. The OLED pixel driving circuit as claimed in claim 6, wherein the first thin film transistor is a driving thin film transistor, the sixth thin film transistor is a switching thin film transistor.

13. An organic light-emitting diode (OLED) pixel driving method, comprising:

providing an OLED pixel driving circuit;

entering an initialization stage;

entering a threshold voltage storage stage; and entering a light-emitting stage;

wherein the OLED pixel driving circuit comprises:

a first thin film transistor, a second thin film transistor, a third thin film transistor, a fourth thin film transistor, a fifth thin film transistor, a sixth thin film transistor, a capacitor and an OLED;

a gate of the fifth thin film transistor receiving a fourth scan signal, a source of the fifth thin film transistor receiving a positive power supply, a drain of the fifth thin film transistor being connected to a drain of the third thin film transistor and a source of the first thin film transistor;

a gate of the third thin film transistor receiving a second scan signal, both a source of the third thin film transistor and a source of the fourth thin film transistor receiving a data voltage or an initial voltage, a gate of the fourth thin film transistor receiving a third scan signal;

a gate of the first thin film transistor being connected to a source of the second thin film transistor and one terminal of the capacitor, another terminal of the capacitor being grounded;

a gate of the second thin film transistor receiving a first scan signal, a drain of the second thin film transistor being connected to a drain of first thin film transistor, a drain of the fourth thin film transistor and a drain of the sixth thin film transistor; and a gate of the sixth thin film transistor receiving the fourth scan signal, a source of the sixth thin film transistor being connected to an anode of the OLED, a cathode of the OLED receiving a negative power supply;

wherein during the initialization stage, the second thin film transistor is turned on due to a low voltage level of the first scan signal, the fourth thin film transistor is turned on due to a low voltage level of the third scan signal, the third thin film transistor is turned off due to a high voltage level of the second scan signal, the fifth and sixth thin film transistors are turned off due to a high voltage level of the fourth scan signal, and a voltage applied on the gate of the first thin film transistor is the initial voltage;

wherein during the threshold voltage storage stage, the second thin film transistor is turned on due to the low voltage level of the first scan signal, the third thin film transistor is turned on due to the low voltage level of the second scan signal, the fourth thin film transistor is turned off due to the high low voltage level of the third scan signal, the fifth and sixth thin film transistors are turned off due to the high voltage level of the fourth scan signal, and the voltage applied on the gate of the first thin film transistor varies to Vdata-Vth where Vdata is the data voltage, and Vth is the threshold voltage of the first thin film transistor;

wherein during the light-emitting stage, the second thin film transistor is turned off due to the high voltage level of the first scan signal, the third thin film transistor is turned off due to the high voltage level of the second scan signal, the fourth thin film transistor is turned off due to the high low voltage level of the third scan signal, the fifth and sixth thin film transistors are turned on due to the low voltage level of the fourth scan signal, the OLED emits light, so that a current flowing through the OLED does not correlate with a threshold voltage of the first thin film transistor.

14. The OLED pixel driving method as claimed in claim 13, wherein a source voltage of the first thin film transistor is changed to the positive power supply and a gate voltage of the first thin film transistor remains unchanged during the light-emitting stage, so that a current flowing through the OLED does not correlate with the threshold voltage of the first thin film transistor.

15. The OLED pixel driving method as claimed in claim 13, wherein both the source of the third thin film transistor and the source of the fourth thin film transistor receive the initial voltage during the initialization stage;

both the source of the third thin film transistor and the source of the fourth thin film transistor receive the data voltage during the threshold voltage storage stage and the light-emitting stage.

16. The OLED pixel driving method as claimed in claim 13, wherein the first scan signal, the second scan signal, the third scan signal and the fourth scan signal are all generated through an external timing controller.

17. The OLED pixel driving method as claimed in claim 13, wherein the first thin film transistor is a driving thin film transistor, the sixth thin film transistor is a switching thin film transistor.

18. The OLED pixel driving method as claimed in claim 13, wherein each of the first thin film transistor, the second thin film transistor, the third thin film transistor, the fourth thin film transistor, the fifth thin film transistor and the sixth thin film transistor is one of a low-temperature polysilicon thin film transistor, a metal oxide semiconductor thin film transistor and an amorphous silicon thin film transistor.

19. The OLED pixel driving method as claimed in claim 13, wherein the first thin film transistor, the second thin film transistor, the third thin film transistor, the fourth thin film transistor, the fifth thin film transistor and the sixth thin film transistor are all P-type thin film transistors.

* * * * *